US005232386A

United States Patent [19]

Gifford

[11] Patent Number: 5,232,386

[45] Date of Patent: Aug. 3, 1993

[54] COUNTER ROTATING STRUT DRIVE

[76] Inventor: William J. Gifford, 335 W. Moss Mill Rd., Egg Harbor City, N.J. 08215

[21] Appl. No.: 988,872

[22] Filed: Dec. 10, 1992

[51] Int. Cl.[5] ..... B63H 5/10

[52] U.S. Cl. ..... 440/80; 440/66; 440/82; 416/129

[58] Field of Search ..... 440/80, 81, 82, 66; 416/128, 129 R, 129 A

[56] References Cited

U.S. PATENT DOCUMENTS

| | | | |
|---|---|---|---|
| 479,008 | 7/1892 | Lowe | 416/129 A |
| 2,067,023 | 1/1937 | Schleicher | 74/389 |
| 2,393,234 | 1/1946 | Burgess | 416/129 R |
| 3,167,361 | 1/1965 | Snapp et al. | 308/8 |
| 3,437,069 | 4/1969 | Bennett | 440/82 |
| 3,583,356 | 6/1971 | Barker | 115/34 |
| 3,983,464 | 2/1976 | Gill | 115/34 C |
| 4,604,032 | 8/1986 | Brandt et al. | 416/128 |
| 4,792,314 | 12/1988 | McCormick | 440/81 |
| 5,017,168 | 5/1991 | Ackley | 440/82 |

FOREIGN PATENT DOCUMENTS

| | | | |
|---|---|---|---|
| 438087 | 7/1991 | European Pat. Off. | 440/80 |
| 369864 | 4/1939 | Italy | 416/128 |

*Primary Examiner*—Sherman Basinger
*Assistant Examiner*—Thomas J. Brahan
*Attorney, Agent, or Firm*—Jacobson, Price, Holman & Stern

[57] ABSTRACT

A strut mounted, counter rotation marine propeller propulsion system of the single engine is provided including a depending propeller shaft strut from which aligned front and rear propeller shafts are supported including remote ends disposed exteriorly of the strut and having front and rear propellers, respectively, mounted thereon and adjacent ends drivingly interconnected through the utilization of bevel gearing within a journal hub carried by the lower end of the strut. The forward extremity of the front propeller shaft is removably coupled to the rear end of a rearwardly and downwardly inclined power shaft journaled through the bottom of the associated hull and the strut includes horizontally outwardly projecting and forwardly and upwardly inclined opposite side water deflector plates for smoothing out the water discharge, in conjunction with the strut itself, from the front propeller. Still further, the strut is secured to the bottom of the associated hull through the utilization of structure enabling its ready removable from the hull bottom without interfering with the water tight integrity of the bottom.

11 Claims, 2 Drawing Sheets

COUNTER ROTATING STRUT DRIVE

BACKGROUND OF THE INVENTION

Field of the Invention

A removable propeller shaft strut is provided for use in conjunction with a boat hull having an inboard motor and a rearwardly and downwardly inclined power shaft terminating rearwardly closely forward of the strut, the latter including aligned forwardly and rearwardly projecting front and rear propeller shafts journaled therefrom upon which front and rear propellers are mounted and the adjacent ends of the propeller shafts being drivingly coupled for equal and inverse rotation. The forward end of the front propeller shaft is aligned with and driven from the rear of the power shaft through the utilization of a removable torque transfer coupling.

Description of Related Art

Various different forms of marine propulsion systems including some of the general structural and operational features of the instant invention heretofore have been provided. Examples of such previously know marine propulsion systems are disclosed in U.S. Pat. Nos. 2,067,023, 3,167,361, 3,583,356, 3,938,464, 4,604,032, 4,792,314 and 5,017,168.

However, these previously known devices do not include the overall combination of structural and operational features incorporated in the instant invention.

SUMMARY OF THE INVENTION

The counter rotating propeller strut drive has been specifically designed for use on small inboard powered boats as well as larger inboard powered vessels and incorporates front and rear counter rotating propellers disposed immediately forward and rearward of associated propeller shaft strut, the interior of the strut including bevel gears drivenly connecting adjacent ends of front and rear propeller shaft sections for equal and opposite rotation.

By utilizing only simple bevel gearing in conjunction with axially spaced front and rear propeller shaft sections upon which front and rear propellers are removably mounted, a simplified counter rotating propeller assembly is provided which utilizes conventional, well developed seals for sealing the interior of the strut assembly against the entrance of ambient water thereinto.

Further, the associated strut incorporates structure by which it may be readily dismounted from the associated hull and readily removable drive connection structure is provided for drivingly connecting the power shaft of the associated boat or vessel to the front propeller shaft section.

The main object of this invention is to provide a counter rotating propeller strut drive for an inboard powered vessel enabling easy access to each of two separate propeller shaft sections to thereby provide an assemblage to which access may be readily had for maintenance and repair purposes.

Another object of this invention is to provide a marine drive in accordance with the preceding object whereby in the event one of the propellers thereof is damaged repair thereto or removal thereof may be reasonably readily effected.

Still another important object of this invention is to provide a marine drive affording counter rotation of axially aligned propellers whose manufacture and installation may be carried out at relatively low cost.

A further object of this invention is to provide a tandem counter rotating propeller drive for a vessel wherein water flow efficiency intermediate the tandem propellers is maintained.

Another object of this invention is to provide a marine drive incorporating tandem counter rotating propellers which may be of conventional design and need not be developed specifically for a given tandem counter rotating propeller installation.

A final object of this invention to be specifically enumerated herein is to provide a tandem counter rotating marine propeller drive which will conform to conventional forms of manufacture, be of simple construction and efficient in operation so as to provide an assembly which will be economically feasible, long lasting and relatively trouble free in operation.

These together with other objects and advantages which will become subsequent apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
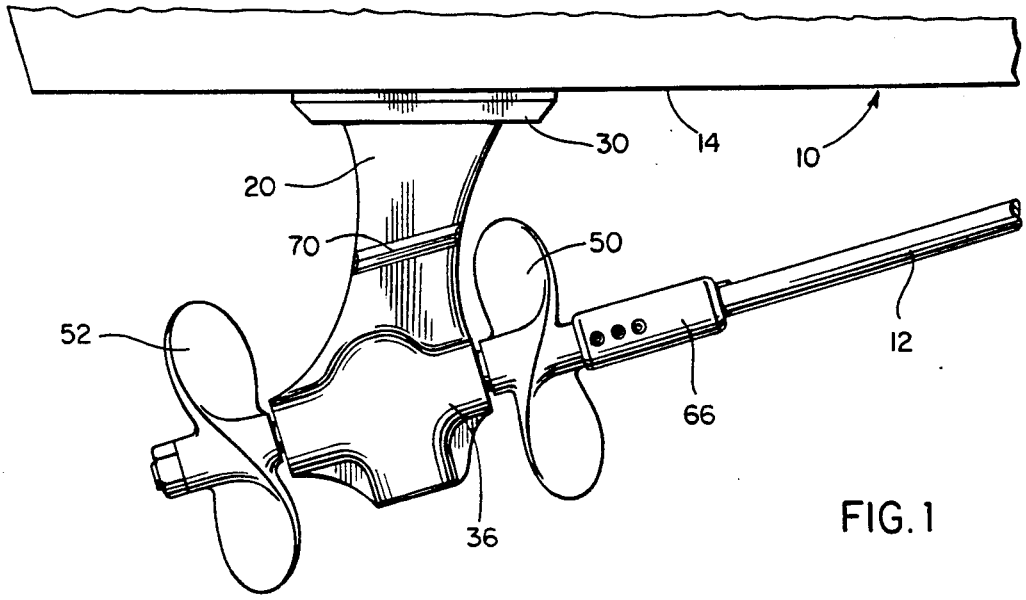
FIG. 1 is a fragmentary side elevational view of the aft portion of a boat hull utilizing the counter rotating strut drive of the instant invention and as seen from the starboard side of the hull.
Figure 2:
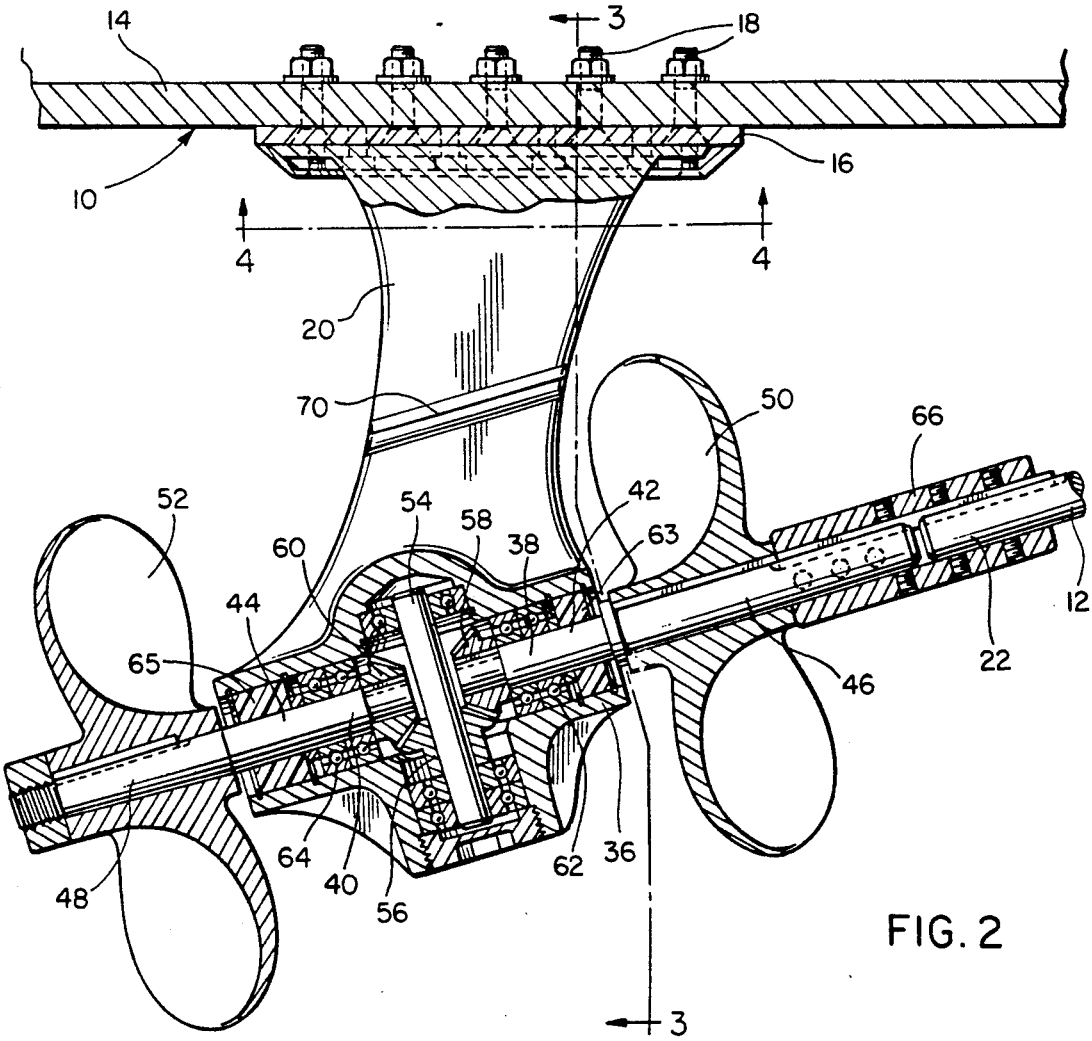
FIG. 2 is an enlarged vertical sectional view of the assemblage illustrated in FIG. 1.
Figure 3:
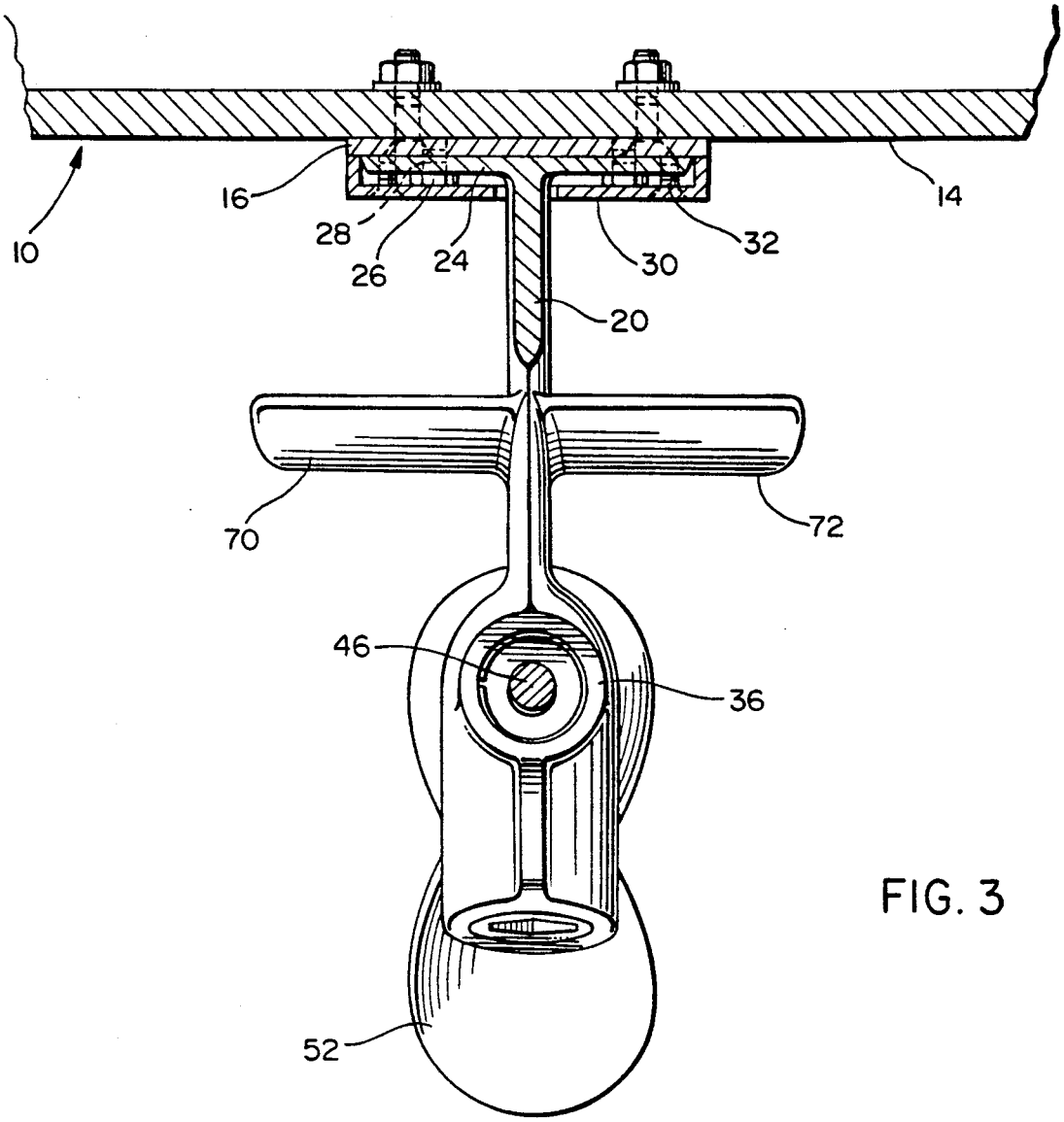
FIG. 3 is a fragmentary vertical sectional view taken substantially upon the plane indicated by the section line 3—3 of FIG. 2.
Figure 4:
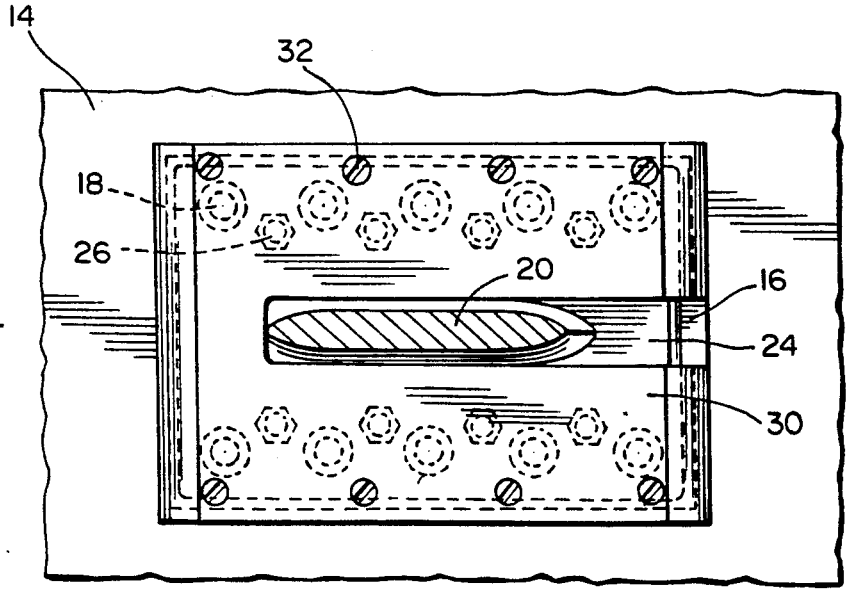
FIG. 4 is a fragmentary horizontal sectional view taken substantially upon the plane indicated by the section line 4—4 of FIG. 2.

Referring now more specifically to the drawings the numeral 10 generally designates a boat hull of substantially flat bottom construction, but which may include other than a flat bottom. The hull 10 includes a rearwardly and downwardly inclined power shaft 12 journaled through the bottom 14 thereof in any convenient manner (not shown) and a strut mounting plate 16 is secured to the underside of the bottom 14 through the utilization of through bolts 18.

A substantially vertically disposed propeller shaft strut 20 is disposed closely rearward of the rear end 22 of the power shaft 12 and includes an upper end attaching plate 24 removably attached to the strut mounting plate 16 through the utilization of readily removable fasteners 26. The fasteners 26 pass through suitable bores 28 formed through the attaching plate 24 and are threadingly engaged in the strut mounting plate 16 in a manner such that removable of the fasteners 26 and the attaching plate 24 will not effect the water tight integrity of the bottom 14.

In addition, a slotted cover plate 30 is provided and removably secured to the attaching plate 24 by fasteners 32 and provides a streamlined housing for the attachment of the propeller shaft strut 20 in order to maintain water resistance to a minimum.

The lower end portion of the propeller shaft strut 20 defines an enlarged hub portion 36 in which adjacent ends 38 and 40 of front and rear propeller shafts 42 and 44 are journaled. The front and rear ends 46 and 48 of the front and rear shafts 42 and 44 have counter rotating front and rear propellers 50 and 52 removably mounted thereon.

The interior of the housing portion 36 also journals a shaft 54 disposed normal to the shafts 42 and 44 and the shaft 54 has a bevel gear 56 thereon meshed with a pair of bevel gears 58 and 60 mounted on the shafts 42 and 44, whereby the axially spaced and aligned shafts 42 and 44 are geared together for simultaneous and opposite rotation.

The bevel gear 56 may be mounted in fixed relation on the shaft 54, in which case the shaft 54 will be journaled from the housing portion 36 or the shaft 54 may be stationary with the bevelled gear 56 journaled thereon, the front and rear shafts 42 being journaled through the utilization of bearings 62 and 64, there being provided conventional, well developed seals 63 and 65 for preventing water entrance into the hub portion 36.

The shafts 44 and 46 are aligned with each other and the rear end 22 of the rearwardly and downwardly inclined propeller shaft 12. Further, the rear end 22 of the shaft 12 is releasably drivenly coupled to the front end of the front shaft 42 through the utilization of a torque coupling sleeve 66.

The intermediate height portion of the strut 20 includes opposite side water deflector plate portions 70 and 72 which project generally horizontally outwardly from the strut 20. The water deflector plate portions 70 and 72 are inclined rearwardly and downwardly at generally the same inclination as the power shaft 12 and serve, in conjunction with the strut 20, to smooth out and direct the discharge of water from the front propeller 50 to the rear propeller 52. Also, at speeds above planing speeds, the deflector plate portions function to apply an upward thrust on the bottom 12 through the strut 20 and to thereby offset the usual tendency of a smaller inboard boat to experience bow rise during initial acceleration or to maintain a bow up inclination at cruising speeds.

The foregoing is considered as illustrative only of the principles of the invention. Further, since numerous modifications and changes will occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination with a boat hull including a bottom structure downwardly from which a strut depends having a lower portion defining a hub, a front-to-rear extending power shaft journaled through said bottom structure and including a rear end terminating forward of said hub, said hub including aligned, axially spaced front and rear propeller shafts journaled therefrom whose remote end portions are disposed exteriorly of said hub and whose adjacent end portions are disposed internally of said hub, front and rear marine propellers mounted on said remote end portions of said front and rear propeller shafts, respectively, said adjacent ends and said hub including gear train means drivingly connecting said propeller shafts for equal and opposite rotation, and means removably drivingly connecting said rear end of said power shaft to the adjacent end of said front propeller shaft.

2. The combination of claim 1 wherein said power shaft and front propeller shaft are substantially aligned and forwardly and upwardly inclined.

3. The combination of claim 2 wherein said strut includes water deflector plate means projecting at least generally horizontally outwardly of the opposite sides of said strut at an elevation at least generally horizontally aligned with the upper portion of the upper sweep area of said front propeller.

4. The combination of claim 1 wherein said deflector plate means is forwardly and upwardly inclined.

5. The combination of claim 1 including strut mounting plate means at least semi-permanently mounted from said bottom structure and attaching means removably attaching the upper portion of said strut to said strut mounting plate means.

6. The combination of claim 5 wherein said attaching means includes a generally horizontal attaching plate carried by the upper end of said strut underlying and removably secured to said strut mounting plate means.

7. The combination of claim 6 including a streamlined cover plate removably upwardly secured over said strut mounting plate means and said attaching plate.

8. The combination of claim 1 wherein said gear train means includes first bevel gear means mounted on each of said adjacent end portions and second bevel gear means journaled within said hub for rotation about an axis normal to said propeller shafts and with diametrically opposite peripheral portions of said second bevel gear means meshed with said first bevel gear means.

9. The combination of claim 8 wherein said power shaft and front propeller shaft are substantially aligned and forwardly and upwardly inclined.

10. The combination of claim 9 wherein said strut includes water deflector plate means projecting at least generally horizontally outwardly of the opposite sides of said strut at an elevation at least generally horizontally aligned with the upper portion of the upper sweep are of said front propeller.

11. The combination of claim 1 wherein said strut includes water deflector plate means projecting at least generally horizontally outwardly of the opposite sides of said strut at an elevation at least generally horizontally aligned with the upper portion of the upper sweep are of said front propeller.

* * * * *